US012195216B1

(12) United States Patent
Orr et al.

(10) Patent No.: US 12,195,216 B1
(45) Date of Patent: Jan. 14, 2025

(54) BAG TRANSPORTING AND FILLING APPARATUS

(71) Applicants: Clyde S. Orr, Redding, CA (US); Timothy E. Orr, Redding, CA (US)

(72) Inventors: Clyde S. Orr, Redding, CA (US); Timothy E. Orr, Redding, CA (US)

(73) Assignee: TORR INDUSTRIES, INC., Redding, CA (US)

( * ) Notice: Subject to any disclaimer, the term of this patent is extended or adjusted under 35 U.S.C. 154(b) by 23 days.

(21) Appl. No.: 18/211,164

(22) Filed: Jun. 16, 2023

(51) Int. Cl.
*B65B 3/04* (2006.01)
*B65B 43/46* (2006.01)

(52) U.S. Cl.
CPC ..... *B65B 3/045* (2013.01); *B65B 43/465* (2013.01)

(58) Field of Classification Search
CPC ..... B65B 3/045; B65B 43/465
See application file for complete search history.

(56) References Cited

U.S. PATENT DOCUMENTS 3,087,518 A * 4/1963 Scholle ..... B65B 3/28 141/315
3,242,951 A * 3/1966 Curie ..... B65D 75/5877 251/149
3,447,281 A * 6/1969 Buford ..... B65B 3/32 141/90
3,592,004 A * 7/1971 Lense ..... B65B 43/36 53/385.1
3,596,430 A * 8/1971 Parish ..... B65B 43/465 206/499
3,975,888 A * 8/1976 Jones ..... B65B 3/02 53/562
4,055,032 A * 10/1977 Hammond ..... B29C 66/1122 53/410
4,120,134 A * 10/1978 Scholle ..... B65B 43/123 53/472
4,158,943 A * 6/1979 Lack ..... B65B 43/262 53/506
4,297,929 A * 11/1981 Schieser ..... B26D 7/0675 83/578
4,363,338 A * 12/1982 Brown ..... B65B 3/045 53/492
4,386,636 A * 6/1983 Ellert ..... B65B 3/045 141/10
4,417,607 A * 11/1983 Scholle ..... B65B 55/022 141/10
4,446,674 A * 5/1984 Inada ..... B65B 1/34 53/502
4,494,363 A * 1/1985 Rica ..... B65B 7/2878 53/88
4,506,489 A * 3/1985 Schieser ..... B65B 43/54 53/64
4,519,184 A * 5/1985 Brunswick ..... B65B 31/06 53/503
4,574,559 A * 3/1986 Rutter ..... B65B 7/28 53/268

(Continued)

*Primary Examiner* — Dariush Seif
(74) *Attorney, Agent, or Firm* — Theodore J. Bielen, Jr.

(57) ABSTRACT

An apparatus for transporting and liquid filling of a bag utilizing an existing liquid filler mechanism. The apparatus includes a support for the bag, a track for guiding the bag, and a shuttle for urging the bag to the conveyor of the existing liquid filler mechanism. The support, track, and shuttle are positioned at an angle to the conveyor platform of the existing liquid filler mechanism.

11 Claims, 8 Drawing Sheets

(56) References Cited

U.S. PATENT DOCUMENTS 4,620,411 A * 11/1986 Schieser ..... B65B 43/123 53/570
4,648,233 A * 3/1987 Holland ..... B65B 5/04 53/284.7
4,892,124 A * 1/1990 Thomsen ..... B65B 3/045 141/168
5,095,962 A * 3/1992 Lloyd-Davies ..... B65B 3/045 141/354
5,129,212 A * 7/1992 Duffey ..... B65B 55/022 141/10
5,238,032 A * 8/1993 McGregor ..... B65B 1/22 141/73
5,573,048 A * 11/1996 Moon ..... B65B 43/123 141/370
6,148,874 A * 11/2000 Rutter ..... B65B 55/022 141/10
6,997,352 B2 * 2/2006 Sallows ..... B67D 7/0294 222/509
8,567,645 B1 * 10/2013 Orr ..... B67D 3/04 222/105
10,934,039 B2 * 3/2021 Black ..... B65B 3/06
11,377,246 B2 * 7/2022 Menear ..... B65B 67/1211
11,912,451 B2 * 2/2024 Nakamoto ..... B65B 43/18
2003/0196411 A1 * 10/2003 Schroeder ..... B65B 9/093 53/410
2003/0233812 A1 * 12/2003 Rogers ..... B65B 61/186 53/469
2004/0139697 A1 * 7/2004 Reddy ..... B29C 66/131 53/412
2004/0139704 A1 * 7/2004 Savage ..... B65B 55/10 53/469
2005/0242122 A1 * 11/2005 Dyer ..... B65B 3/045 222/179.5
2007/0137727 A1 * 6/2007 Stricklin ..... B65B 3/045 141/114
2008/0008403 A1 * 1/2008 Fergusson ..... B65D 75/5822 53/425
2008/0041018 A1 * 2/2008 Stephenson ..... B65D 77/065 53/449
2009/0075032 A1 * 3/2009 Rutter ..... B65H 18/28 428/521
2011/0271645 A1 * 11/2011 Odman ..... B65B 43/26 53/571
2012/0317936 A1 * 12/2012 Murray ..... B65B 3/045 53/545
2015/0033677 A1 * 2/2015 Vaucher ..... B65B 1/06 53/52
2016/0059978 A1 * 3/2016 Nakagawa ..... B65B 43/465 198/610
2017/0008697 A1 * 1/2017 Gillard ..... B65D 77/061
2020/0361692 A1 * 11/2020 Jackson ..... B32B 27/34
2020/0391921 A1 * 12/2020 Jackson ..... B32B 27/34

* cited by examiner

BAG TRANSPORTING AND FILLING APPARATUS

BACKGROUND OF THE INVENTION

Many potable liquids, such as wine, juice, dairy products, and the like are packaged in a flexible pouch or container. In many cases, such packaging utilizes a bag-in-box method where the pouch or bag is seated inside a box, which may be a corrugate fiberboard box. Automated filling systems are used to create a bag-in-box packaging where webbed bag are fed into such filling systems. Webbed bags generally have perforations between each of the bags. The automated filling systems separate the bags automatically and fill the same with a particular liquid.

Reference is made to a high production automatic web fed filler system identified as the "Torr Model 145B". Such filler utilized a web of perforated bags with the cap of each bag in a trailing position. The bags are filled automatically while still on the web and sent down an outfeed conveyor in this process. The filled bag is then automatically placed into a box to complete the packaging.

The processing of liquids such as wine, syrups, milk products, and the like are often packaged in a bag of a particular construction, identified as a "standup" bag. Standup bags are generally less flexible and incompatible with the bag fillers used to process bag-in-box bags. Consequently, different fillers must be used to process bags associated with bag-in-box packaging and standup bags. Thus, a need exists for an apparatus which is capable of processing bag-in-box bags, as well as standup bags in a common apparatus.

In the past, manipulating of flexible bags by liquid filling the same in a conveyor mechanism have been devised. For example, China Patent 1165452C describes the processing of a double bag by the use of an endless conveyor.

U.S. Pat. No. 4,055,032 describes the formation of flexible bags on a web and the securing of a tap to the bags to allow filling of the same.

U.S. Pat. No. 4,648,233 shows an apparatus for a conveyor that supports filled flexible bags from one location to another on a continuous basis utilizing a conveyor system.

German Patent DE19929529 describes a transport mechanism in which left and right transport feeds deliver items to a longitudinal central conveyor.

U.S. Pat. No. 6,931,824 describes a method of filling a flexible pouch and delivering the pouches to an end feed conveyor in a predetermined orientation. The pouches are then sealed, cooled, and checked for integrity.

There is a need for providing an apparatus for the transporting and liquid filling of bags of a particular configuration utilizing the body of an established bag-in-box filling mechanism.

SUMMARY OF THE INVENTION

In accordance with the present application, an apparatus for transporting a bag for filling, utilizing an existing liquid filler mechanism, having a liquid delivery device for an incompatible bag, is herein provided.

The apparatus of the present application employs a support having a surface for slidingly engaging the bag. A track lies adjacent the support for the bag and includes a slot for guiding the bag fitment along the track as well as guiding the bag body along the support. The support and track are oriented in a dimension that is angularly disposed to the dimension of the immobilized conveyor platform of an existing liquid filler mechanism. The support and track are supported to the existing liquid filler mechanism such that the conveyor dimension of the existing liquid filler mechanism orients along a first dimension while the support track for the bag is oriented along a second dimension. In essence, the support and track may constitute a "side feed" relative to the conveyor platform of the existing liquid filler mechanism. The bags being fed to the support and track of such "side feed" may be manually or automatically accomplished.

The bags exiting the slot of the track are then directed to a shuttle. The shuttle includes an element for engaging the bag filament and urging the filament and connected bag body to a position above the conveyor platform of the existing liquid filler mechanism and against an edge deflector, which is lowered to the conveyor platform. The movement of such conveyor platform has been interrupted. Needless to say, the conveyor platform's first dimension is used as a reference for the movement of the bag sliding along the support and moving through the track, which is oriented in the second dimension. The shuttle element is alternately positioned from contact with the filament of the bag to a location apart from the fitment of the bag, in order to accommodate the handling of successive bags. Once the bag has been moved to the conveyor platform, the edge deflector is retracted A plate overlies the conveyor platform and comprises a surface for holding at least a portion of the bag urged to a position above the conveyor platform by the shuttle. An active pusher of the liquid delivery device of the existing liquid filler mechanism urges the bag to an active liquid dispenser of the same device. Once positioned on the plate, a motivator advances the plate to the active liquid dispenser of the existing liquid filler mechanism where the bag is filled with a particular liquid. The motivator further repositions to force the liquid filled bag from the conveyor platform. Consequently, the motivator also causes the plate to then retreat in order to receive a successive bag which has been urged onto a position above the conveyor platform by the shuttle.

The motivator, shuttle, and edge deflectors are operated by air cylinders which are activated by sensors that detect the position of the bag along its route from the bag support to the liquid dispenser of the existing liquid filler mechanism. A bin may be employed to lie adjacent the liquid deliver device of the existing liquid filler mechanism in order to gather liquid filled bags.

It may be apparent that a novel and useful apparatus for transporting a bag for liquid filling with the liquid deliver device of an existing liquid filler mechanism, has been hereinabove described.

It is therefore an object of the present application to provide an apparatus for filling and transporting a bag in conjunction with an existing liquid filler mechanism, which employs the existing liquid filler mechanism, stationary conveyor platform, and the liquid delivery device of the liquid filler mechanism.

Another object of the present application is to provide an apparatus for filling and transporting a bag utilizing an existing liquid filler mechanism that feeds the bag to the stationary conveyor platform of the existing liquid filler mechanism at an angle relative to the conveyor platform, constituting a side feed arrangement.

Another object of the present application is to provide an apparatus for filling and transporting a bag in conjunction with an existing liquid filler mechanism that is able to fill the bag with liquid utilizing the liquid delivery device of the existing liquid filler mechanism, even though the bag being filled has an incompatible characteristic with the bags normally processed by the existing liquid filler mechanism.

Another object of the present application is to provide an apparatus for filling and transporting a bag in conjunction with an existing liquid filler mechanism that obviates the need for providing multiple liquid filler mechanisms that are independent of one another.

Another object of the present application is to provide an apparatus for filling and transporting a bag in conjunction with an existing liquid filler mechanism that is economical in use.

Yet another object of the present application is to provide an apparatus for filling and transporting a bag in conjunction with an existing liquid filler mechanism where the apparatus is easily connected to the existing liquid filler mechanism for support therefrom.

The application possesses other objects and advantages especially as concerns particular characteristics and features thereof, which will become apparent as the specification continues.

BRIEF DESCRIPTION OF THE SEVERAL VIEWS OF THE DRAWING

FIG. 9 is a sectional view taken along line 10-10 of FIG. 9.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments thereof which should be taken in conjunction with the prior referenced drawings.

Figure 1:
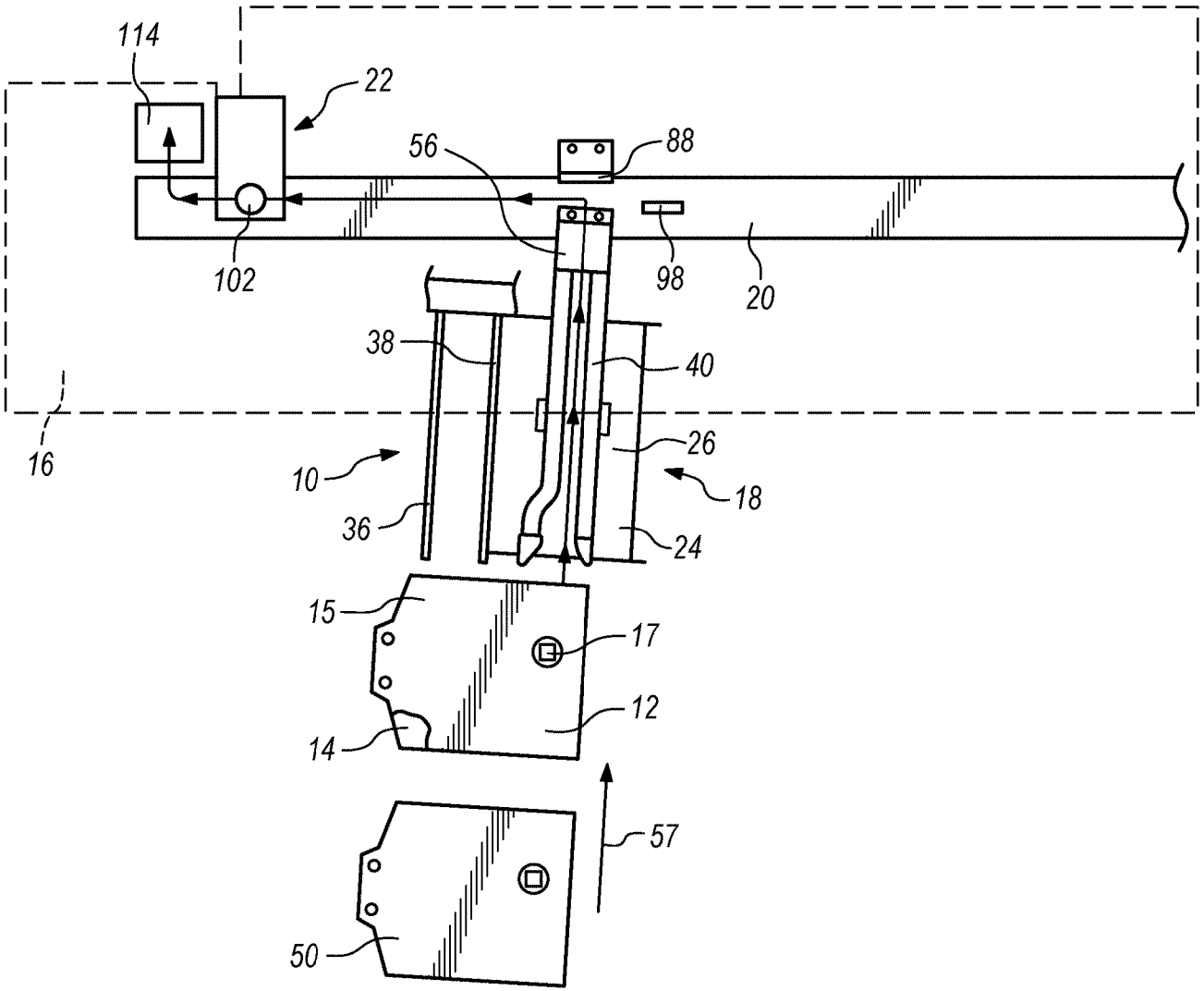
FIG. 1 is a top plan schematic view of the apparatus of the present application being attached to an existing liquid filler mechanism.

With reference to FIG. 1, it may be observed that an apparatus 10 for transporting and filling flexible bags 12 is depicted schematically. Flexible bags 12 are typically constructed of plastic material and have a body 15 defining an inner chamber 14 and a fitment 17 which is employed to fill liquid contents associated with bag 12. For example, bag 12 may hold juice, syrup, wine, dairy products, and the like. Apparatus 10 is connected to and operates with a known or existing conventional liquid filler mechanism 16, such as one identified as the "Torr Model 145B" manufactured and distributed by Torr Industries, Inc. of Redding, CA. Liquid filler mechanism 16 is normally used to package bag-in-box containers. However, liquid filler mechanism 16 is not able to process other types of flexible bags, such as bags known as "standup bags". The use of apparatus 10 permits the processing of bag-in-box packaging as well as standup bags, as will be described hereinafter. Again, viewing FIG. 1, it may be seen that apparatus 10 includes a feeder mechanism 18 which deposits flexible bags 12 on a conveyor surface 20 of liquid filler mechanism 16. Conveyor 20 has been disabled and merely serves as a stationary support or a platform. On the other hand, the liquid delivery device of liquid filler mechanism 16 is active and used in conjunction with apparatus 10. Feeder mechanism 18 is angularly disposed relative to conveyor or platform 20, a "side feed arrangement". The details of the interaction between apparatus 10 and liquid filler mechanism 16 will be detailed as the specification continues.

Figure 2:
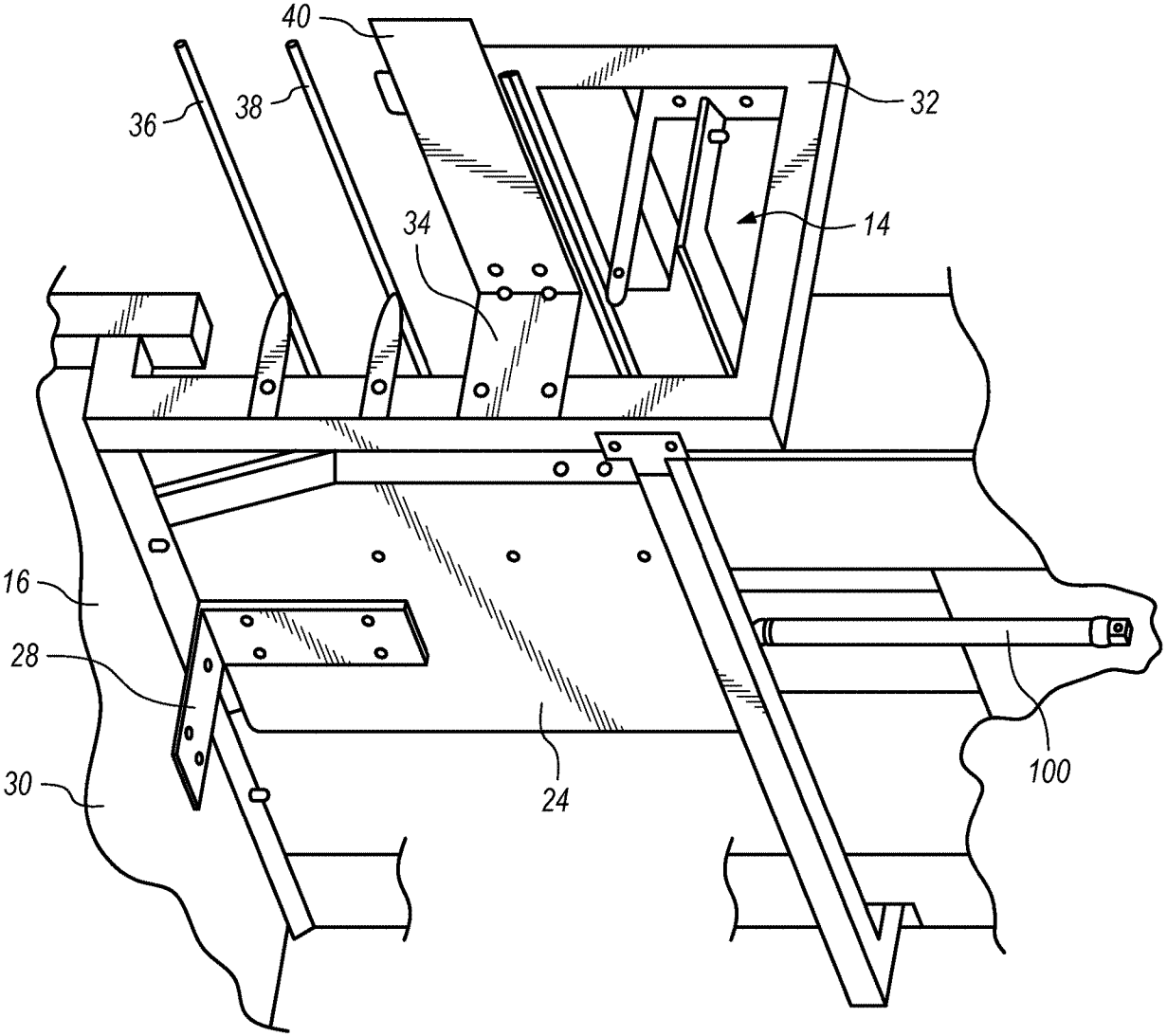
FIG. 2 is a bottom plan perspective view showing the partial construction of the physical connection of the apparatus to the existing liquid filler mechanism.

Looking at FIG. 2, it may be observed that the connection of apparatus 10 to liquid filler mechanism 16 is partially depicted and shows a support 24 which has a surface 26 for slidingly contacting a bag, such as bag 12, being fed into apparatus 10, FIGS. 1 and 2. Support 24 is held to structural elements of liquid filler mechanism 16 in any conventional manner and is shown, in part, as being connected by angle iron 28 to surface 30 and to a U-shaped beam 32 by plate 34. Of course, other structural beams may be employed to connect apparatus 10 to liquid filler mechanism 16 as long as the support 24 of feeder mechanism 18 allows a bag, such as bag 12, to pass to conveyor surface 20 of liquid filler mechanism 16. It should also be noted that rods 36 and 38 are shown on FIG. 2 and are used to further support bag, such as bag 12, in its movement to conveyor surface 20.

Figure 3:
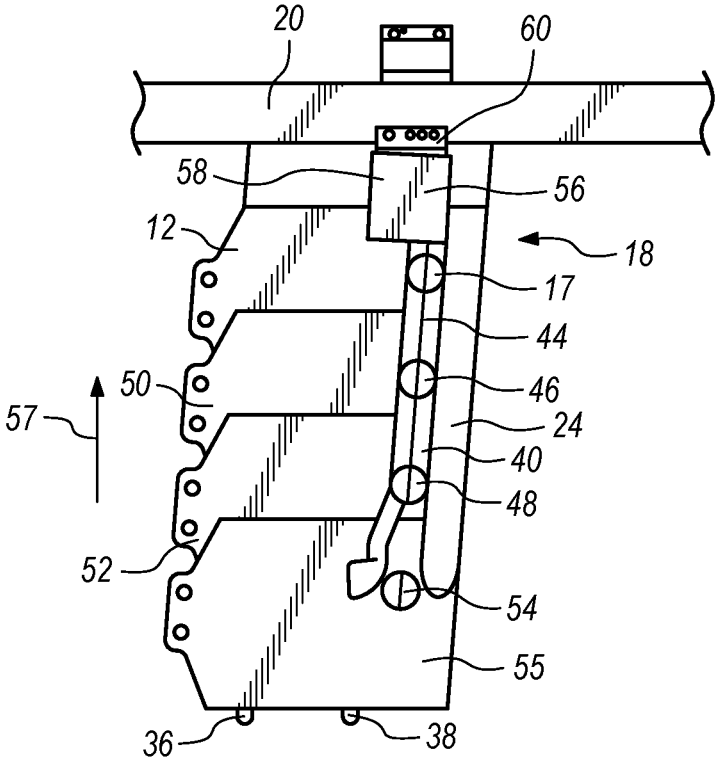
FIG. 3 is a top plan view of the feeder mechanism, including a two-part track having a slot for guiding bag fitments.
Figure 4:
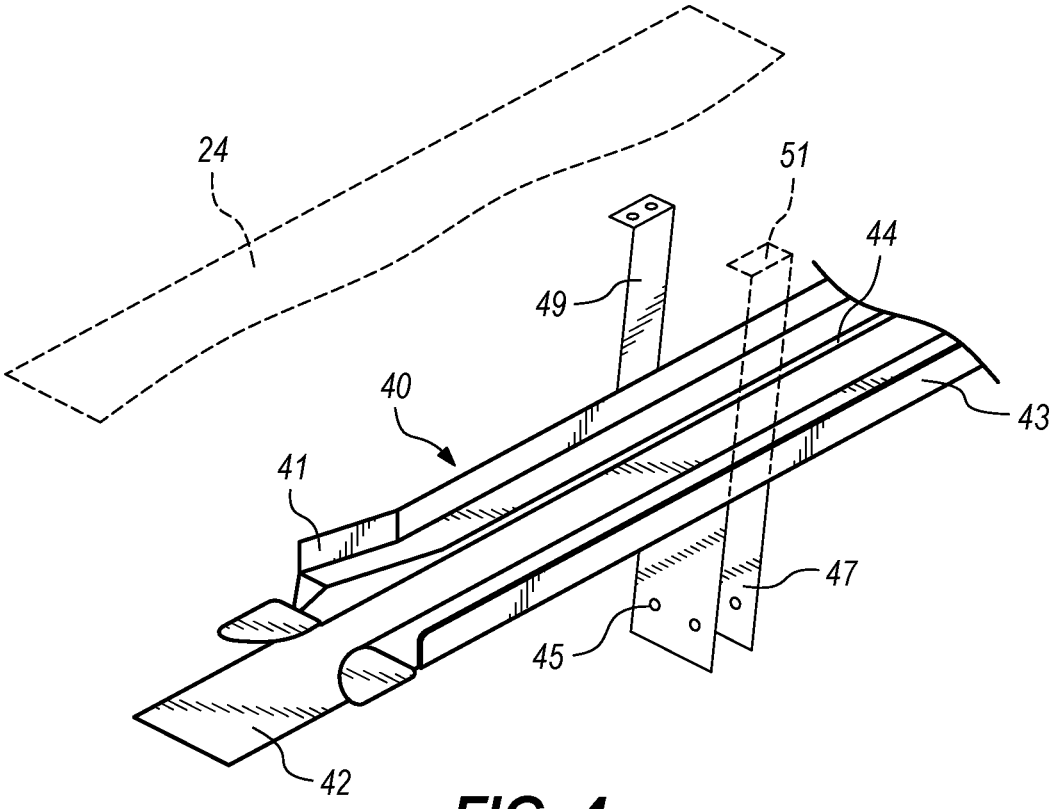
FIG. 4 is a top right perspective view of the two-part track portion and supports of the feeder mechanism shown in FIG. 3.

FIGS. 3 and 4 illustrate the track 40, which is a portion of feeder mechanism 18. Track 40 is formed of parts 41 and 43 which are individually supported by existing liquid filler mechanism 16 through guides 45 and 47, as well as hangars 49 and 51. Again, other suitable supports may be used to connect track 40 to existing liquid filler mechanism 16. Track 40 is provided with an entry lip 42 and a formed slot 44. Slot 44 is capable of engaging the fitment of a bag 17 connected to bag body 15. FIG. 3 illustrates slot 44 holding fitments 46 and 48 of bags 50 and 52. The fitment 54 of bag 55 is about to enter slot 44. It should be noted that bags 12, 50, 52, and 55 are stacked upon each other and are manually fed into slot 44 of track 40, the bodies of which lie atop support 24 and rods 36 and 38, FIG. 2, and beneath track 40. Directional arrow 57, FIG. 3, indicates the movement of bags 12, 50, 52, and 55 relative to track 40.

Figure 5:
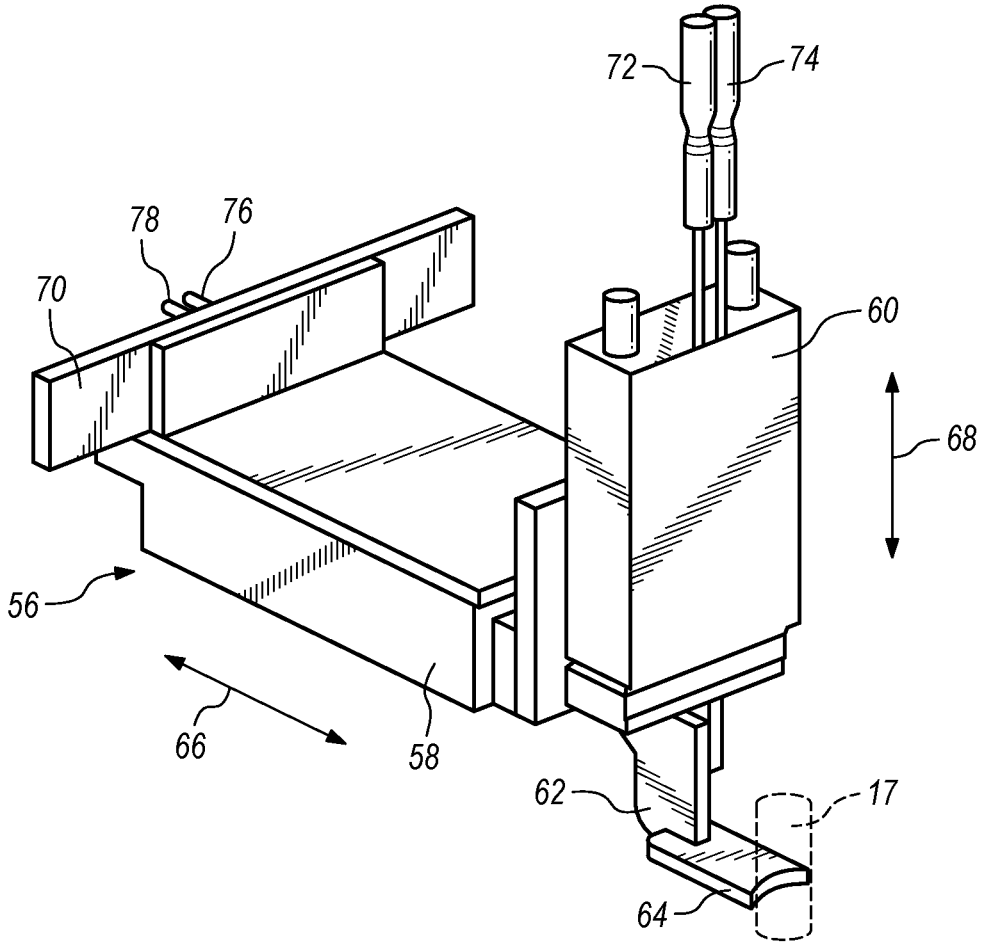
FIG. 5 is a top left front perspective view of the shuttle utilized in the present application.

A shuttle 56 moves bags from track 40 to conveyor surface 20. Shuttle 56 is shown in FIG. 5 and includes air cylinder 58 and air cylinder 60. Air cylinder 58 may be of the type identified by 20BX100S while air cylinder 60 may be of the type identified by 16BX75S. Air cylinders 58 and 60 may originate from Automation Direct of Atlanta, Georgia. Shuttle 56 also includes element 62 having an end surface 64 for contacting fitments of bags being fed along track 40. Fitment 17 of bag 12 is illustrated in FIG. 5 as being in contact with end surface 64 of element 62. Air cylinder 58 moves element 62 according to directional arrow 66, in a generally horizontal direction, while air cylinder 60 moves element 62 according to directional arrow 68, in a generally vertical direction. Plate 70 is employed to fasten shuttle 56 to existing liquid filler mechanism 16 for support. Sensors 72 and 74 of air cylinder 60 are employed to control the movement of air cylinder 60 according to directional arrow 68. Likewise, sensors 76 and 78 are employed to control the movement of air cylinder 58 according to directional arrow 66.

Figure 6:
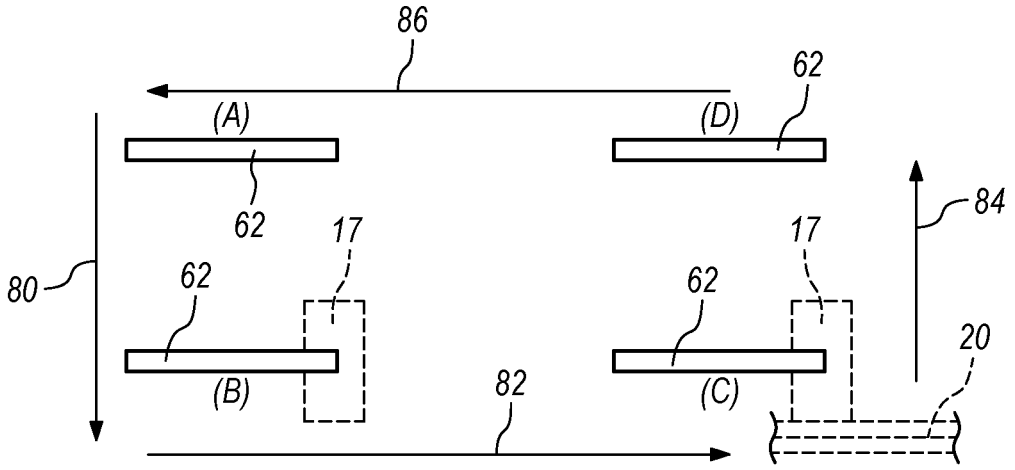
FIG. 6 is a diagrammatic view illustrating the movement of the shuttle element shown in FIG. 5.

FIG. 6 depicts the travel of element 62 with respect to exemplar fitment 17 and are sequentially labeled (A)-(D) on FIG. 6. Initially, element 62 lies in position (A) until exemplar fitment 17 moves into the vicinity of shuttle 56. Once sensors 72 and 74 detect fitment 17, element 62 is lowered into position (B) to engage fitment 17, the body 15 of bag 12 being connected thereto. Such lowering of element 62 is actuated by air cylinder 60 and is indicated by directional arrow 80. When element 62 and end surface 64 engage fitment 17, fitment 17 is moved horizontally according to directional arrow 82 to a position above the conveyor surface 20, indicated by rendition (C). At this point, element 62 is lifted vertically according to directional arrow 84 into position (D) by air cylinder 60. Air cylinder 58 then moves element 62 back to position (A), according to directional arrow 86, to begin the cycle again and in order to engage the succeeding fitment shown as fitment 46 of bag 44 on FIG. 3. Again, the movement of any of the bags shown in FIG. 3 may be done manually or by automation in order to assume a position for contacting element 62 of shuttle 56.

Figure 7:
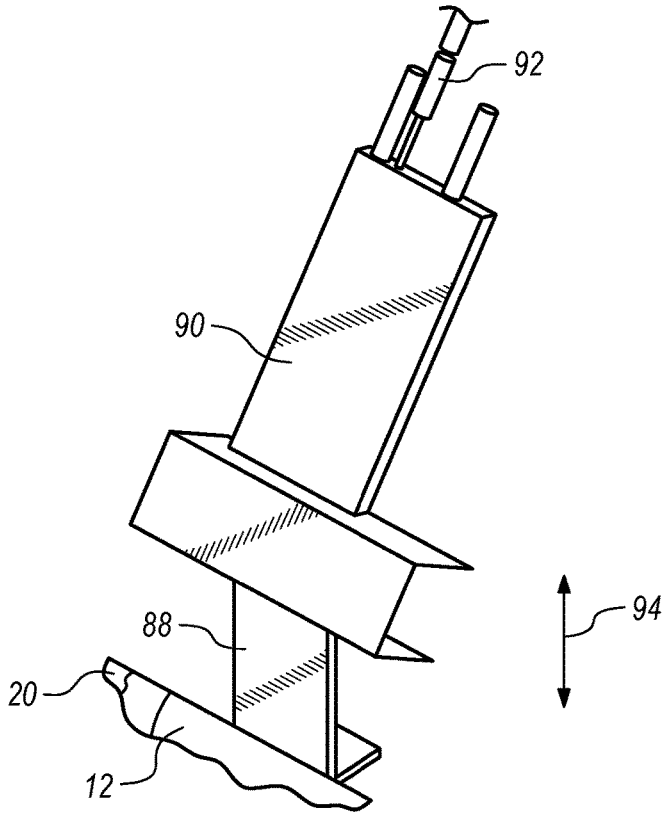
FIG. 7 is a front top right perspective view of the edge deflector utilized in the apparatus of the present application.

Viewing FIG. 7, bag 12 is shown as being moved to a position directly above conveyor platform 20. At this juncture, an edge deflector 88 is lowered to conveyor platform 20 to prevent bag 12 from traveling beyond conveyor platform 20. Edge deflector 88 includes an air cylinder 90 which may be identified as a Model 12BX125S, available from Automation Direct of Atlanta, Georgia. In addition, a sensor 92, which may be identified as a Model 4MMT-Slot, aids in the movement of edge deflector 88 to a position adjacent bag 12 on conveyor platform 20. Directional arrow 94 indicates the movement of edge deflector 88 relative to conveyor platform 20.

Figure 8:
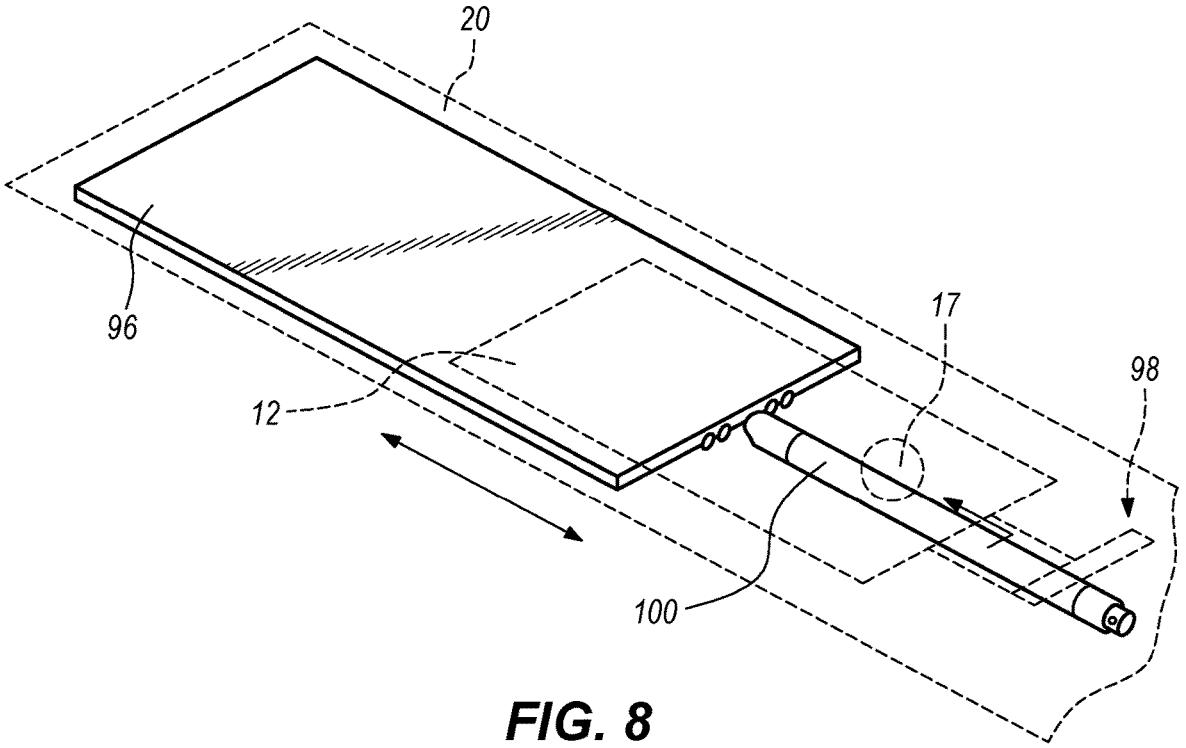
FIG. 8 is a top right front perspective view of the plate lying atop the stationary conveyor platform of the existing liquid filler mechanism depicted in phantom.

Turning to FIG. 8, it may be observed that bag 12 has been positioned relative to conveyor platform 20 to lie at least partially atop a plate 96, which sits above conveyor platform 20. Bag 20 is then able to be advanced along conveyor platform 20 by a pusher 98, which is an active portion of liquid delivery device 22 found in liquid filler mechanism 16, the movement of which will be discussed as the specification continues.

Figure 9:
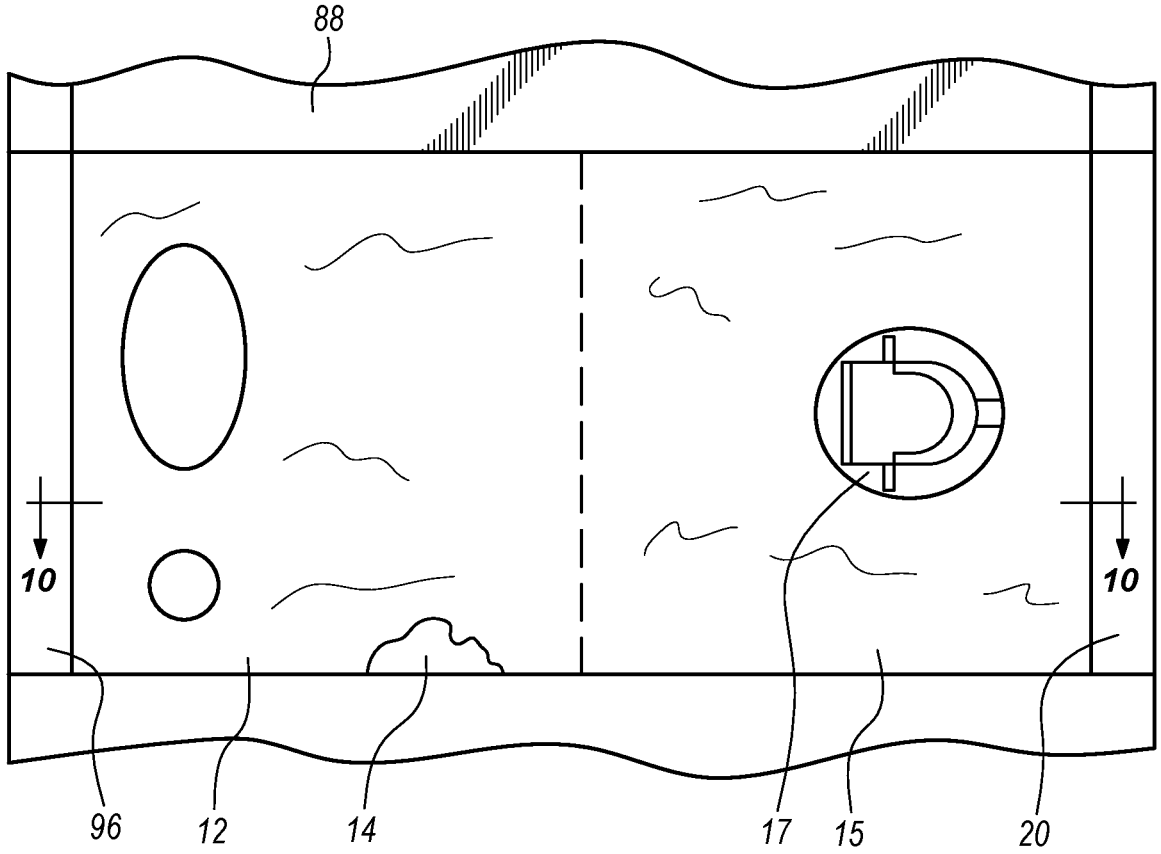
FIG. 9 is a top plan view of a bag positioned on the stationary conveyor platform of the existing liquid filler mechanism.
Figure 10:
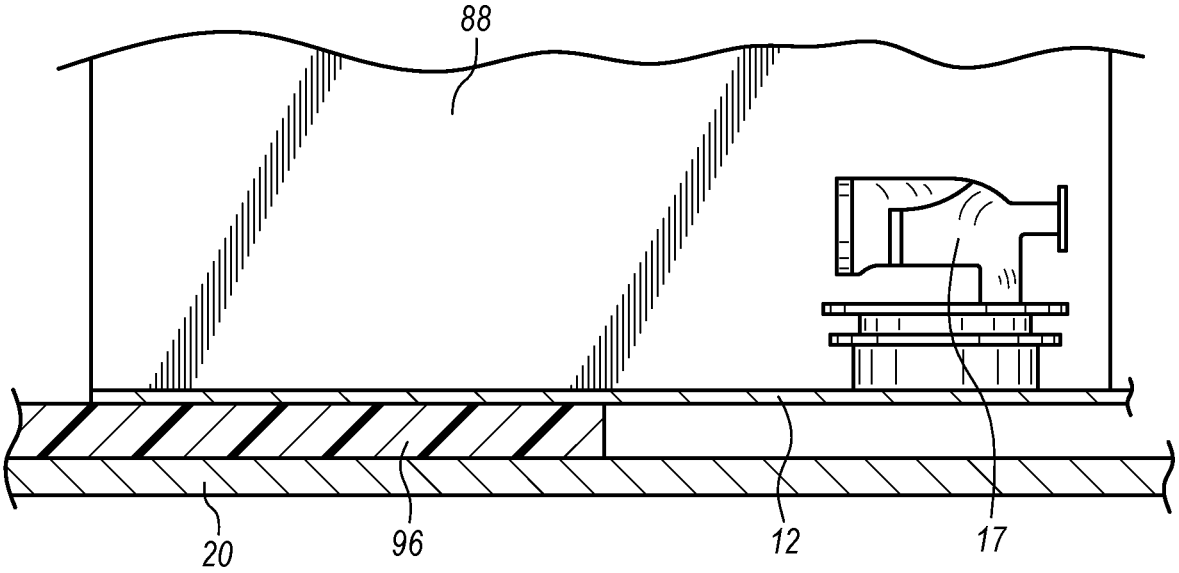
FIG. 10 is a sectional view taken along line 10-10 of FIG. 9.

Looking at FIGS. 9 and 10, it may be observed that bag 12 is shown as lying over conveyor platform 20 and against edge deflector 88 with at least a portion of the same positioned atop plate 96, which itself is movable by a motivator in the form of a linked air cylinder 100, FIG. 8. Bag 12 is illustrated with fitment 17 shown in greater detail and with chamber 14 defined by body 15.

Figure 11A:
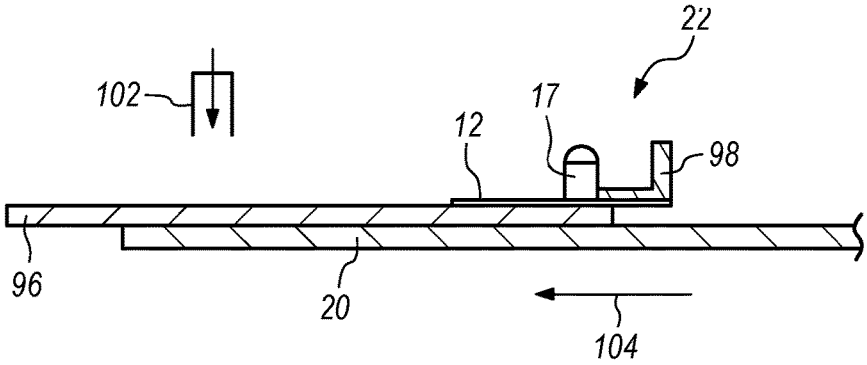
FIGS. 11A-11D are schematic views depicting the sequential movement of a bag on the conveyor platform and the filling of the same by the liquid delivery device of the liquid filler mechanism.
Figure 11B:
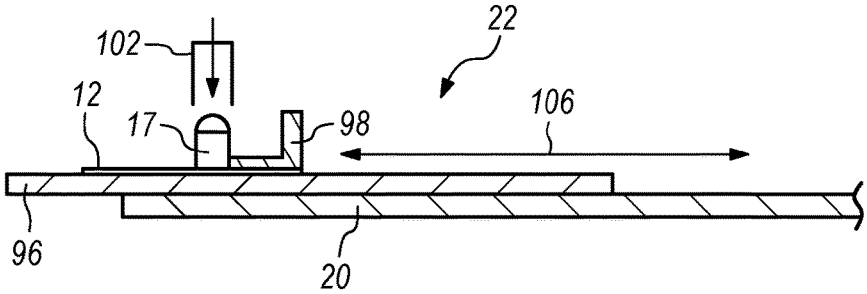
Figure 11C:
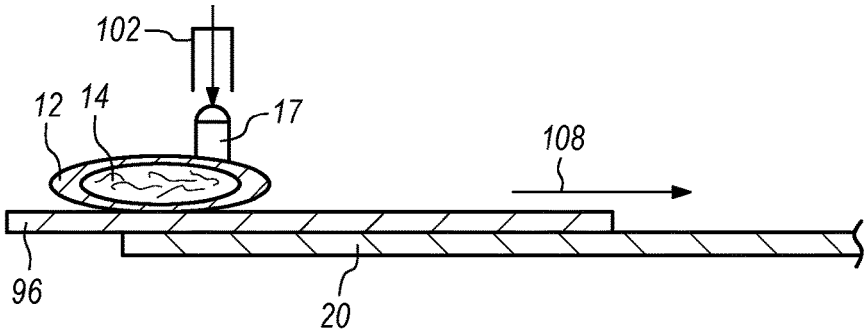
Figure 11D:
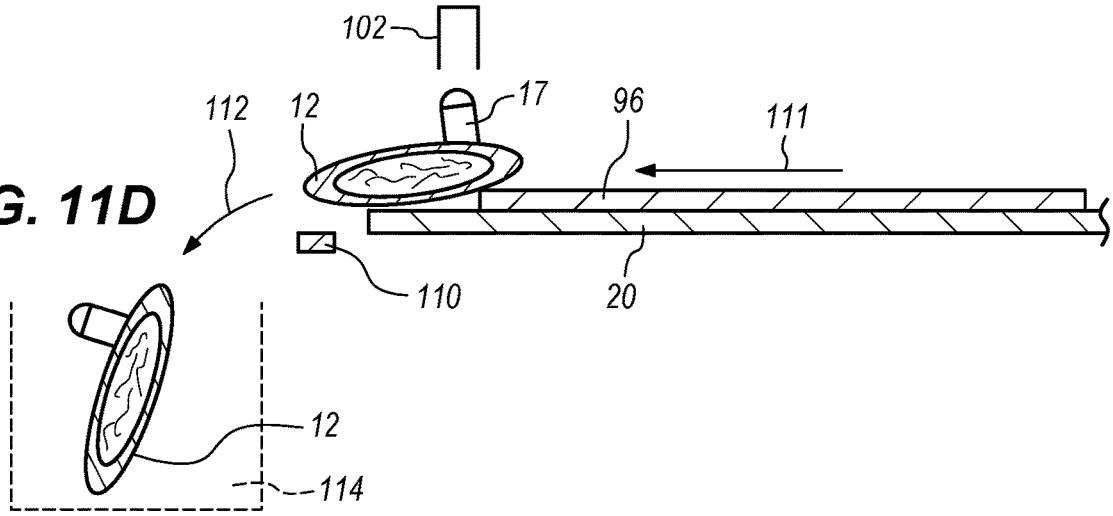

FIG. 11A-D shows the sequential movement of bag 12 relative to conveyor platform 20 to effect the filling process. FIG. 11 shows active pusher 98 of liquid deliver device 22 contacting fitment 17 of bag 12 to move fitment 17 along plate 96, which has been positioned along conveyor platform 20 by motivator 100 to lie beneath bag liquid dispenser 102, which is also an active portion of existing liquid delivery device 22. Directional arrow 104 illustrates the movement of plate 96 relative to conveyor platform 20. FIG. 11B shows the movement of bag 12 to a position directly beneath bag liquid dispenser 102. Directional arrow 106 illustrates the movement of pusher 98 to and from the vicinity of bag liquid dispenser 102. FIG. 11C shows the filling of chamber 14 of bag 12 by bag liquid dispenser 102 while bag 12 lies atop plate 96. Directional arrow 108 depicts the retreat of plate 96 from filled bag 12 and FIG. 11D shows the position of plate 96 after its retreat from bag 12. FIG. 11D also shows the position of plate 96 where it contacts with filled bag 12. Directional arrow 111 depicts filled bag 12 being moved or nudged away from conveyor 20 over an end bar 110 by the force exerted by plate 96. Directional arrow 112 shows the falling of bag 12 into a bin 114 for storage.

Figure 12:
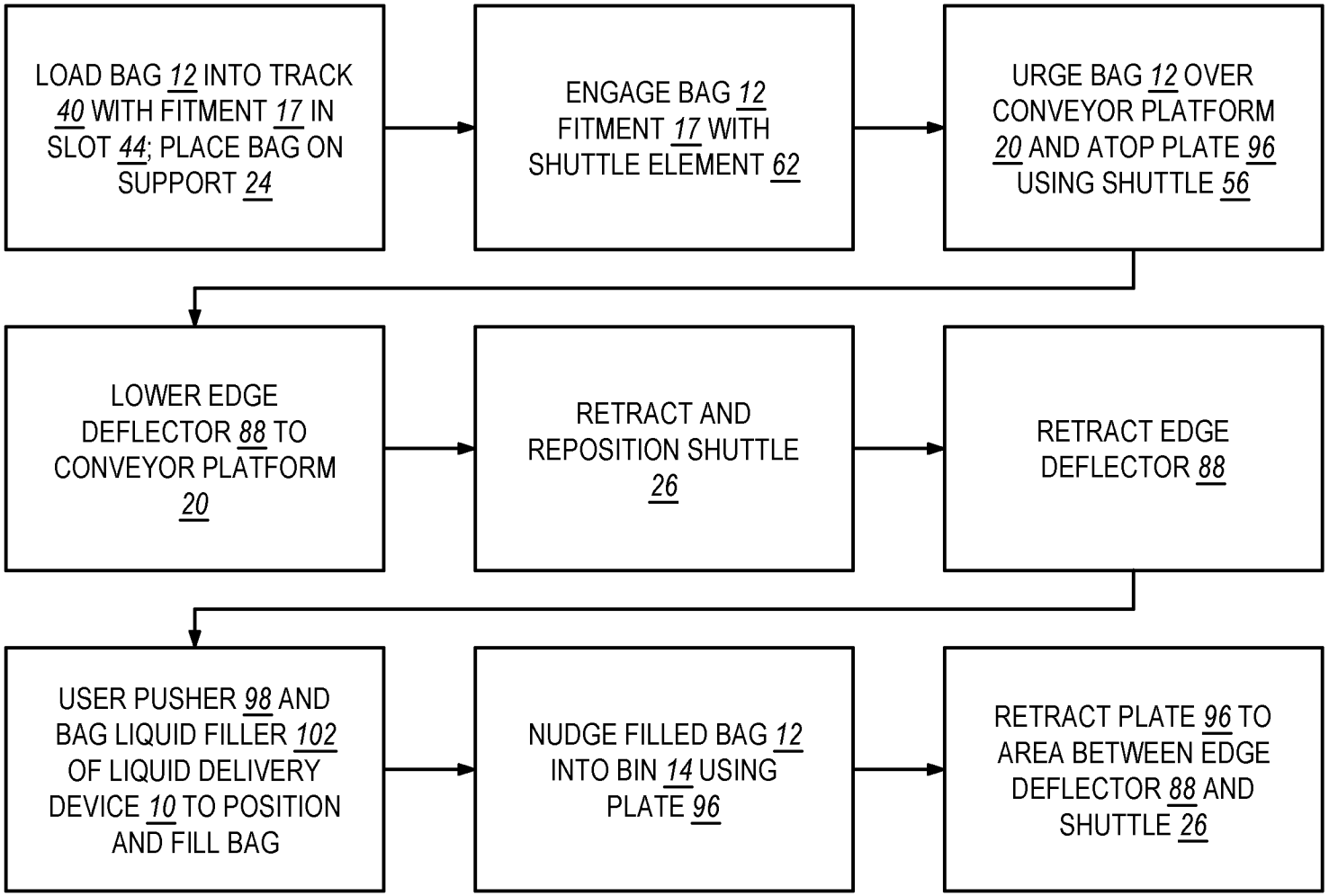
FIG. 12 is a block diagram showing the sequential operation of the apparatus of the present application.

Turning to FIG. 12, a block diagram illustrates the overall processing of a flexible bag, such as bag 12, that is schematically shown in FIG. 1. Following the path revealed by FIG. 1, bag 12 is loaded onto track 40 such that fitment 17 lies in slot 44. The body 15 of bag 12 then lies on top of support 24 and rods 36 and 38. Shuttle element 62, in turn, engages the fitment 17 of bag 12 and urges bag 12 to a position over conveyor platform 20 and, at least partially, atop plate 26. Edge deflector 88 is then lowered to conveyor platform 20 to . . . further position bag 12. Shuttle 26 and edge deflector 88 are retracted. Pusher 98 then moves bag along plate 96 to bag liquid dispenser 102. Filled bag 12 is then nudged or forced into bin 14 using plate 96. Plate 86 is then retracted to an area between edge deflector 88 and shuttle 26 for the transporting of a subsequent bag, shown as bag 50 on FIG. 1.

In essence, apparatus 10 permits the filling of incompatible bags and obviates the need for the provision of separate bag fillers to achieve this result.

While in the foregoing, embodiments of the application have been set forth in considerable detail for the purposes of making a complete disclosure of the application, it may be apparent to those of skill in the art that numerous changes may be made in such details without departing from the spirit and principles of the application.

What is claimed is:

1. An apparatus for transporting and liquid filling of a bag having a body with a chamber and a connected fitment extending from the body, the fitment permitting communication with the chamber, the apparatus being connected to and operating in combination with an existing liquid filler mechanism, possessing a liquid delivery device and a conveyor platform oriented along a first dimension, comprising:

a support for the bag, said support comprising a surface for slidingly contacting the bag, said support oriented along a second dimension;

a track oriented along said second dimension angularly disposed relative to the first dimension of the conveyor platform of the liquid filler mechanism, said track further including a slot for guiding the bag fitment along said track and guiding the bag body along said support;

a shuttle, said shuttle comprising an element for engaging the bag fitment from said slot and urging the fitment and the connected bag body to a position over the conveyor platform of the liquid filler mechanism, said shuttle element being movable from a position at said fitment of the bag to a position apart from said fitment;

a plate, said plate overlying the conveyor platform and comprising a surface for holding at least a portion of the bag urged to a destination over the conveyor platform by said shuttle; and a motivator for adjusting said plate holding at least a portion of the bag to the liquid delivery device of the liquid filler mechanism for liquid filling of the bag, said motivator further positioning said plate to force the liquid filled bag from the liquid delivery device.

2. The apparatus of claim 1 in which said motivator additionally comprises a first air cylinder.

3. The apparatus of claim 2 in which said shuttle comprises a second air cylinder for moving said shuttle element engaging the fitment and urging the fitment and the connected bag body to the vicinity of the conveyor, and in which said shuttle further comprises a third air cylinder for moving said shuttle element from a position at the fitment to a position apart from said fitment.

4. The apparatus of claim 3 in which said shuttle second and third air cylinders are capable of moving said element back and forth and up and down relative to the support for the bag.

5. The apparatus of claim 2 which additionally comprises an edge deflector for confining the position of the bag on the conveyor platform, following the bag being urged over the conveyor platform.

6. The apparatus of claim 5 in which said motivator additionally comprises a first air cylinder.

7. The apparatus of claim 6 in which said shuttle comprises a second air cylinder for moving said shuttle element engaging the fitment and urging the fitment and said connected bag body to the vicinity of the conveyor, and in which said shuttle further comprises a third air cylinder for moving said shuttle element from a position at the fitment to a position apart from said fitment.

8. The apparatus of claim 7 in which said shuttle second and third air cylinders are capable of moving said element back and forth and up and down relative to the support for the bag.

9. The apparatus of claim 8 which additionally comprises a bin located apart from the liquid delivery device of the liquid filler mechanism, said motivator positioning said plate to force the liquid filled bag from the liquid delivery device and further directing the liquid filled bag to said bin.

10. The apparatus of claim 1 which additionally comprises a bin located apart from the liquid delivery device of the liquid filler mechanism, said motivator positioning said plate to force the liquid filled bag from the liquid delivery device and further directing the liquid filled bag to said bin.

11. The apparatus of claim 1 which additionally comprises a sensor for detecting the presence of the fitment adjacent said shuttle element.

* * * * *